United States Patent [19]

Lew et al.

[11] Patent Number: 4,603,519

[45] Date of Patent: Aug. 5, 1986

[54] GEODESICALLY REINFORCED HONEYCOMB STRUCTURES

[76] Inventors: Hyok S. Lew, 7890 Oak St., Arvada; Michael Stranahan, P.O. Box 15, Woody Creek, both of Colo. 80005

[21] Appl. No.: 682,675

[22] Filed: Dec. 17, 1984

[51] Int. Cl.[4] ..... E04B 1/32

[52] U.S. Cl. ..... 52/81; 52/648; 52/664; 428/3; 428/542.6; 428/116; 428/11; 403/170; 403/174

[58] Field of Search ..... 52/86, 80, 648, 808, 52/806, 669, 664, DIG. 10; 428/3, 542.6, 116, 11; 404/174, 178, 170

[56] References Cited

U.S. PATENT DOCUMENTS

| | | | |
|---|---|---|---|
| 536,435 | 3/1895 | Macdonald | 52/664 |
| 3,139,957 | 7/1964 | Fuller | 52/648 |
| 3,533,894 | 10/1970 | Engelbrecht | 52/806 |
| 4,122,646 | 10/1978 | Sapp | 52/648 |
| 4,156,997 | 6/1979 | Decker | 52/648 |
| 4,439,958 | 4/1984 | Lew | 52/86 |

FOREIGN PATENT DOCUMENTS

| | | | |
|---|---|---|---|
| 127104 | 6/1902 | Fed. Rep. of Germany | 52/666 |
| 2112926 | 3/1971 | Fed. Rep. of Germany | 52/86 |
| 424954 | 4/1974 | U.S.S.R. | 52/648 |

*Primary Examiner*—Henry E. Raduazo

[57] ABSTRACT

This invention relates to a honeycomb structure reinforced with geodesic structure. The honeycomb structure includes a plurality of elongated structural members with cross sections having a large moment of inertia, which are assembled into a hexagonal network. Each hexagonal subassembly included in the hexagonal network is reinforced by a first set of reinforcing elongated structural members disposed in a triangular pattern wherein three corners of the first reinforcing triangular subassembly disposed flush to one face of the hexagonal subassembly are respectively connected to one set of three alternate corners of the hexagonal subassembly and further reinforced by a second set of reinforcing elongated structural members disposed in a triangular pattern wherein three corners of the second reinforcing triangular subassembly disposed flush to the other face of the hexagonal subassembly are respectively connected to the other set of three alternate corners of the hexagonal subassembly. The complete assembly of the flat or curved geodesically reinforced honeycomb structure of the present invention is a honeycomb shell of hexagonal network made of a plurality of elongated structures of substantially flat cross sections, that is sandwiched between a pair of geodesic shells of triangular network made of a plurality of reinforcing elongated structural members wherein each corner of the hexagonal subassemblies of the honeycomb shell is connected either to a corner of a reinforcing triangular subassembly of one geodesic shell or to a corner of a reinforcing triangular subassembly of the other geodesic shell. In modified versions of the geodesically reinforced honeycomb structures, the pair of reinforcing triangular subassemblies included in each hexagonal subassembly may be disposed on a plane substantially including the middle plane of the honeycomb shell, or only one of two reinforcing triangular subassembly may be employed.

11 Claims, 21 Drawing Figures

GEODESICALLY REINFORCED HONEYCOMB STRUCTURES

BACKGROUND OF THE INVENTION

The geodesic dome structure first invented by Buckminister Fuller had been accepted as a novel method of building shelter structures. With few exceptions, the geodesic domes are built of tubular or bar type structural members assembled in triangular or hexagonal networks. Any knowledgable structural engineers can tell that the geodesic dome structures exclussively using tubular or bar type structural members are not the most economic method to build a dome structure, for the construction materials are not used in the form of optimized structural shape and are not assembled into the structurally optimized configuration. It is well known fact that the honeycomb structure provides one of the strongest and most rigid panel structures which are highly effective against perpendicular loadings, because the material is used to create the maximum thickness in the construction of the honeycomb panel. In conventional honeycomb panels, the honeycomb structure is sandwiched between a pair of thin sheets or plates bonded thereto. The honeycomb structure sandwiched between two layers of a truss network provides a strength comparable to the honeycomb structure sandwiched between two plates.

The primary object of the present invention is to provide a hexagonal network of honeycomb shell structures sandwiched between a pair of triangular networks of the geodesic structure.

Another object is to provide a geodesically reinforced honeycomb shell structure including a hexagonal network of elongated structural members having a cross section of large inertia of moment, wherein each hexagonal subassembly is reinforced with a first set of reinforcing elongated structural members arranged in a triangular pattern with three corners respectively connected to the first set of three alternate corners of the hexagonal subassembly, and is further reinforced by the second set of reinforcing elongated structural members arranged in a triangular pattern with three corners respectively connected to the other set of three alternate corners of the hexagonal subassembly.

A further object is to provide a geodesically reinforced honeycomb shell structure wherein the first network of said reinforcing triangular subassemblies is disposed substantially flush to one surface of the honeycomb shell and the second network of said reinforcing triangular subassemblies is dsiposed substantially flush to the other surface of the honeycomb shell.

Yet another object is to provide a geodesically reinforced honeycomb shell structure including said first and second networks of reinforcing triangular subassemblies which are disposed substantially on a plane including the middle plane of the honeycomb shell.

Yet further object is to provide a geodesically reinforced honeycomb shell structure including a network of hexagonal subassemblies reinforced by single network of reinforcing triangular subassemblies.

Still another object is to provide a connector that interconnects three elongated structural members constituting hexagonal subassemblies and six reinforcing elongated structural members constituting reinforcing triangular subassemblies in a radiating pattern.

Still a further object is to provide a universal connector interconnecting honeycomb structural members and geodesic reinforcing structural members, which connector is usable for geodesically reinforced honeycomb shell structures of different curvatures.

These and other objects of the present invention will become clear as the description thereof proceeds.

BRIEF DESCRIPTION OF THE FIGURES

The present invention may be described with a greater clarity and specificity by referring to the following figures.

DESCRIPTION OF THE ILLUSTRATED EMBODIMENTS

Figure 1:
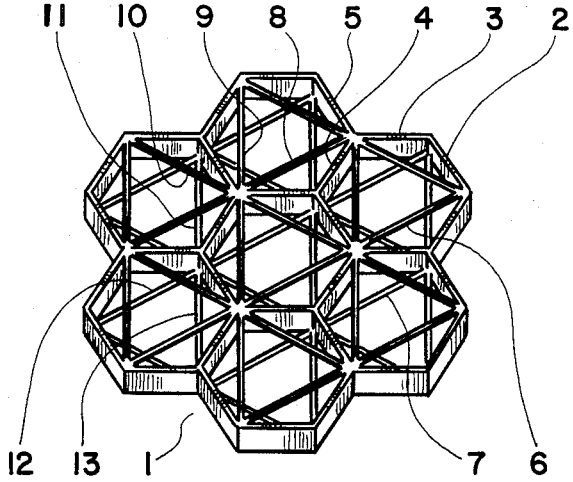
FIG. 1 illustrates a perspective view of a geodesically reinforced honeycomb structure of the present invention comprising a honeycomb shell sandwiched between a pair of geodesic reinforcing networks.

In FIG. 1 there is illustrated a perspective view of a geodesically reinforced honeycomb shell structure 1 constructed in accordance with the principles of the present invention. The honeycomb structure 2 is constructed of a plurality of the elongated members 3, 4, 5, etc. assembled and interconnected into a hexagonal network. The honeycomb structure 2 is sandwiched between two reinforcing triangular networks 6 and 7 respectively constructed of a plurality of reinforcing elongated structural members 8, 9, 10, etc. and 11, 12, 13, etc. The structural members 3, 4, 5, etc. constituting the hexagonal network 2 of the honeycomb structure may be flat bars, wide flange beams, I-beams, Z-beams, etc., which have a cross section of large inertia of moment about the middle plane of the honeycomb structure. The reinforcing elongated structural members 8, 9, 10, 11, 12, 13, etc. may be tubings, structural channels or angles, etc. which have a cross section suitable for bearing the axial loadings such as tension and compression. It should be noticed that each of the first sets of the alternate junctions in the hexagonal network 2 where each set of three elongated structural members constituting the honeycomb structure is connected to each other, anchors and secures six reinforcing elongated structural members constituting the first reinforcing triangular network 6 disposed substantially flush to one surface of the honeycomb structure, while each of the other sets of the alternate junctions in the hexagonal network 2 anchors and secures six reinforcing elongated structural members constituting the second reinforcing triangular network 7 disposed substantially flush to the other surface of the honeycomb structure. Each pair of reinforcing triangular subassemblies comprising the reinforcing elongated structural members included in a hexagonal subassembly comprising the elongated structural members are disposed in positions wherein a sixty degree angle of rotation exists therebetween. It should also be noticed that the reinforcing triangular subassemblies included in the reinforcing triangular networks 6 and 7 also constitute a plurality of the hexagonal assemblies.

Figure 2:
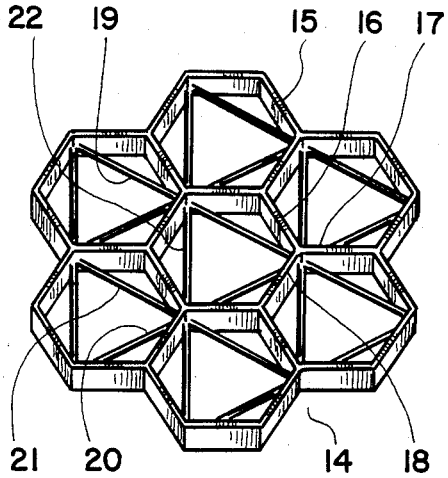
FIG. 2 illustrates a perspective view of another geodesically reinforced honeycomb structure comprising a honeycomb shell including a single geodesic reinforcing network.

In FIG. 2 there is illustrated another embodiment of a geodesically reinforced honeycomb structure 14 including a hexagonal network 15 comprising a plurality of the elongated structural members 16, 17, 18, etc. and a reinforcing triangular network comprising a plurality of the reinforcing elongated structural members 20, 21, 22, etc. wherein the latter is disposed substantially on a plane including the middle plane of the former. Each of the alternate junctions in the hexagonal network 15 supports six reinforcing elongated structural members in a redial pattern.

Figure 3:
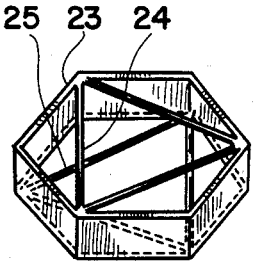
FIG. 3 illustrates a subassembly of the geodesically reinforced honeycomb shell shown in FIG. 1, which includes a hexagonal subassembly sandwiched between a pair of reinforcing triangular subassembly.

In FIG. 3 there is illustrated a perspective view of a complete subassembly constituting the geodesically reinforced honeycomb structure 1 shown in FIG. 1, that includes a hexagonal subassembly 23, the first reinforcing triangular subassembly 24 and the second reinforcing triangular subassembly 25. The hexagonal subassembly 23 is composed of a plurality of flat bars designed to bear the bending moments imposed on the structure, while the reinforcing triangular subassemblies 24 and 25 are respectively composed of tubings or round bars designed to bear the tension or compression exerted on the structure in directions substantially parallel to the middle plane of the structure. The three corners of the reinforcing triangular subassembly 24 disposed substantially flush to one face of the hexagonal subassembly 23 are respectively connected to the first set of three alternate corners of the hexagonal subassembly 23, while the three corners of the second reinforcing triangular subassembly 25 disposed substantially flush to the other face of the hexagonal subassembly 23 are respectively connected to the second set of three alternate corners of the hexagonal subassembly 25; whereby, the hexagonal subassembly 23 is sandwiched between the first and second reinforcing triangular subassemblies 24 and 25. When the subassembly is viewed in a direction perpendicular thereto, it appears as a six-pointed star fitted within a hexagon. It should be understood that a plurality of subassemblies same as that shown in FIG. 3 are integrated into a single continuous structure as shown in FIG. 1 wherein the intergration of the subassemblies into a complete shell structure is executed in such a way that a corner of one reinforcing triangular structure is connected to a corner of adjacent reinforcing triangular structure, and so on. The geodesically reinforced honeycomb structure employing the subassembly shown in FIG. 3 provides a flat panel structure or a shell of infinitely large radius of curvature. In order to construct a geodesically reinforced shell structure of a finite radius of curvature, one has to use a subassembly wherein the hexagonal subassembly thereof is a frustum segment of a hexagonal cone.

Figure 4:
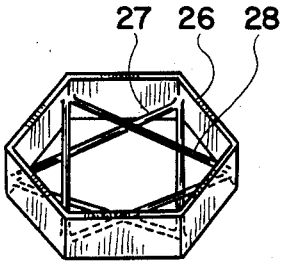
FIG. 4 illustrates another subassembly of a geodesically reinforced honeycomb shell including a hexagonal subassembly reinforced with a pair of reinforcing triangular subassemblies disposed substantially on the middle plane thereof.

In FIG. 4 there is illustrated a subassembly of another geodesically reinforced honeycomb structure wherein the hexagonal subassembly 26 is reinforced by a pair of reinforcing triangular subassemblies 27 and 28 disposed substantially on a plane including the middle plane of the hexagonal subassembly 26. It should be noticed that the pair of reinforcing triangular subassemblies 27 and 28 are disposed slightly offset from one another in positions wherein a sixty degree angle of rotation exists therebetween.

Figure 5:
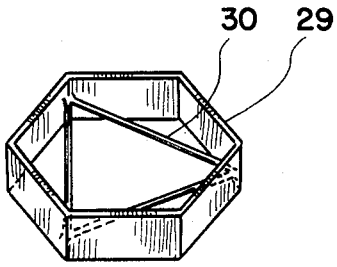
FIG. 5 illustrates a subassembly of the geodesically reinforced honeycomb shell shown in FIG. 2, which includes a hexagonal subassembly reinforced with a reinforcing triangular subassembly disposed substantially on the middle plane thereof.

In FIG. 5 there is illustrated a subassembly of the geodesically reinforced honeycomb structure 14 shown in FIG. 2, which comprises a hexagonal subassembly 29 reinforced with a single reinforcing triangular subassembly 30 disposed substantially on a plane including the middle plane of the hexagonal subassembly 29. The three corners of the reinforcing triangular subassembly 30 are respectively connected to a set of three alternate corners of the hexagonal subassembly 29. The subassemblies are integrated into a single continuous structure 14 as shown in FIG. 2 wherein a corner of one reinforcing triangular subassembly is connected to a corner of adjacent reinforcing triangular subassembly, and so on.

Figure 6:
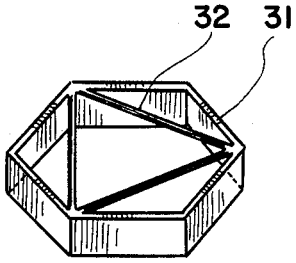
FIG. 6 illustrates another subassembly of a geodesically reinforced honeycomb shell including a hexagonal subassembly reinforced with a reinforcing triangular subassembly disposed substantially flush to one surface of the honeycomb shell.

In FIG. 6 there is illustrated a subassembly of a further geodesically reinforced honeycomb structure, that includes a hexagonal subassembly 31 and a single reinforcing triangular subassembly 32 disposed substantially flush to one face of the hexagonal subassembly 31.

Figure 7:
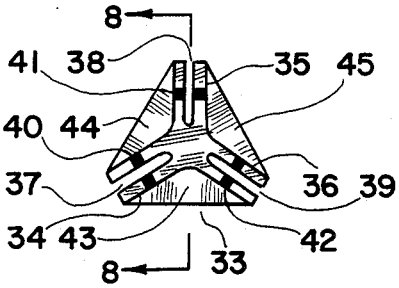
FIG. 7 illustrates a plan view of a connector employed in constructing a geodesically reinforced honeycomb shell.

In FIG. 7 there is illustrated a plan view of a connector 33 that is used to interconnect the elongated structural members constituting the hexagonal network of the honeycomb structure as well as the reinforcing elongated structural members constituting the reinforcing triangular networks. The connector 33 includes three webs 34, 35, and 36 radially extending from the central axis thereof in an axisymmetric pattern wherein three slots 37, 38 and 39 are respectively disposed in three webs 34, 35 and 36 in an axisymmetric configuration. Three webs 34, 35, and 36 include a plurality of bolt holes or rivet holes 40, 41 and 42 disposed therethrough, respectively. The gussets 43, 44 and 45 disposed on a plane perpendicular to the central axis of the connector reinforce the webs 34, 35 and 36 radially extending from the central axis of the connector.

Figure 8:
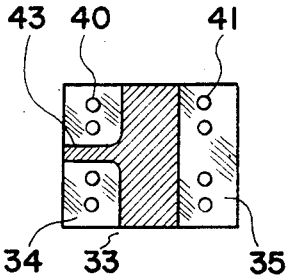
FIG. 8 illustrates a cross section of the connector shown in FIG. 7.

In FIG. 8 there is illustrated a cross section of the connector 33 shown in FIG. 7, that is taken along a plane 8—8 as shown in FIG. 7. Here it is further illustrated that each web includes a plurality of bolt holes or rivet holes disposed therethrough, which holes are for fastening the structural members constituting the honeycomb structure which engage the slots included in the webs of the connector, to the connector by bolting or riveting means.

Figure 9:
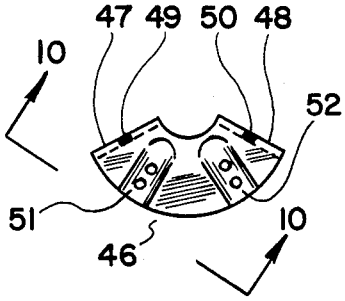
FIG. 9 illustrates a plan view of a connecting bracket that is employed in connecting the reinforcing elongated structural members to the connector shown in FIGS. 7 and 8.

In FIG. 9 there is illustrated a plan view of a connecting bracket 46 which is a bracket plate including a pair of flanges 47 and 48 wherein the oblique angle therebetween is matched to the oblique angle between two adjacent webs included in the connector 33 shown in FIG. 7. The flanges 47 and 48 includes bolt holes or rivet holes 49 and 50 matched to the bolt holes or rivet holes disposed through the webs of the connector 33. The connecting bracket 46 further includes a pair of means 51 and 52 for securing a pair of reinforcing elongated structural members constituting the reinforcing triangular subassembly, which means may be the depressed seats with bolt holes or rivet holes designed to secure the reinforcing circular tubings constituting the reinforcing triangular substructure.

Figure 10:
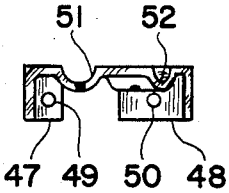
FIG. 10 illustrates a cross section of the connecting bracket shown in FIG. 9.

In FIG. 10 there is shown an elevation view of the connecting bracket 46 viewed through a plane 10—10 as shown in FIG. 9.

Figure 11:
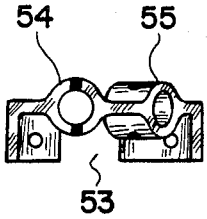
FIG. 11 illustrates a cross section of another embodiment of the connecting bracket.

In FIG. 11 there is shown an elevation view of another embodiment of the connecting bracket 53 having essentially the same construction as the connecting bracket 46 shown in FIG. 9 with one exception being that the pair of means 54 and 55 for securing the reinforcing circular tubings constituting the reinforcing triangular subassembly comprise a pair of circular sockets including a plurality of bolt holes or rivet holes.

Figure 12:
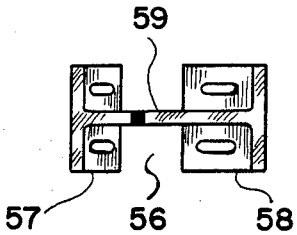
FIG. 12 illustrates a cross section of a further embodiment of the connecting bracket.

In FIG. 12 there is illustrated an elevation view of a further embodiment of the connecting bracket 56 that includes a pair of wide flanges 57 and 58 respectively including a pair of slotted holes. The bracket plate 59 is a flat plate including a plurality of bolt holes or rivet holes, which is designed to secure the rectangular tubings, structural channels or angles employed as the reinforcing elongated structural members constituting the reinforcing triangular subassembly.

Figure 13:
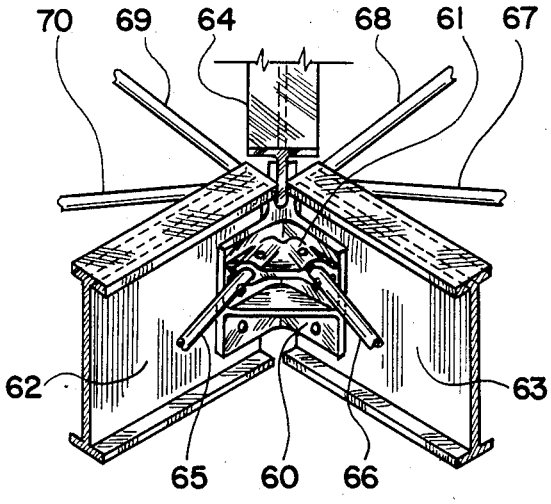
FIG. 13 illustrates perspective view of the assembly including the connector shown in FIG. 7 and the connecting bracket shown in FIG. 9 wherein three elongated structural members constituting the hexagonal network and six reinforcing elongated structural members constituting the reinforcing triangular network are interconnected thereby.

In FIG. 13 there is illustrated a perspective view of a combination including a connector 60 same as the element 33 shown in FIG. 7 and three connecting brackets 61 same as the element 53 shown in FIG. 11, which combination is employed to interconnect three elongated structural members 62, 63 and 64 such as the I-beams constituting the hexagonal subassemblies and six reinforcing elongated structural members 65, 66, 67, 68, 69 and 70 such as the circular tubings constituting the reinforcing triangular subassemblies. Each I-beams with its web engaging the slot included in each web of the connector 60 is fastened to each web by a pair of bolts or rivets. One of each pair of the bolts or rivets fastening each I-beam to each web of the connector 60 is also used to fasten the connecting brackets 61 to the connector 60. The reinforcing circular tubings 65 and 66 engaging the pair of the circular sockets included in the connecting bracket 61 are secured thereto by means of bolting or riveting. Of course, the fastenings employed in the interconnecting the I-beams and the circular tubings by means of the connector assembly may be substituted or reinforced by welding. It should be understood that, in the construction of a geodesically reinforced honeycomb shell structure of a finite radius of curvature, the I-beams constituting the hexagonal subassemblies and the circular tubings constituting the reinforcing triangular subassemblies are connected to the connector-connecting brackets assembly in slightly oblique angles. In other words, the angle between the central axis of the connector 60 and the central axis of the structural members connected thereto are not ninety degrees. Consequently, the end of the I-beams should be cut in slightly oblique angle as dictated by the magnitude of the radius of curvature of the shell structure and the connecting brackets 61 connected to the connector 60 must be pivotable over a small angle when the latters are not tightly fastened to the former.

Figure 14:
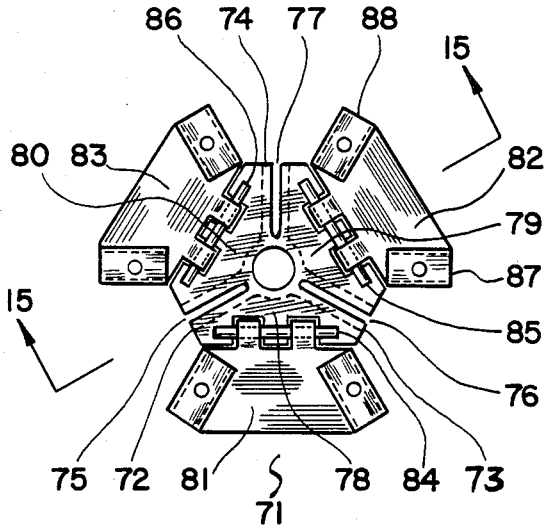
FIG. 14 illustrates a plan view of another connector assembly employed in constructing a geodesically reinforced honeycomb shell.

In FIG. 14 there is illustrated a plan view of another connector assembly 71 that includes three webs 72, 73 and 74 respectively including three slots 75, 76 and 77 radially extending from the central axis of the connector assembly 71 in an axisymmetric pattern. These webs 72, 73 and 74 are interconnected to each other by two sets of gussets respectively disposed at two extremities of the connector assembly 71. One set of three gussets 78, 79 and 80 disposed at one extremity of the connector assembly 71 includes three connecting brackets 81, 82 and 83 pivotably connected to three gussets 78, 79 and 80 by the pivoting hinges 84, 85, and 86, respectively, which pivoting hinges are disposed on a plane perpendicular to the central axis of the connector assembly 71. Each connecting bracket includes a pair of securing means such as the circular sockets 87 and 88 for securing the reinforcing elongated structural members such as the circular tubings constituting the reinforcing triangular subassemblies. Of course, the slots 75, 76 and 77 are to receive the webs of the I-beams or flat section of the flat bars constituting the hexagonal subassemblies.

Figure 15:
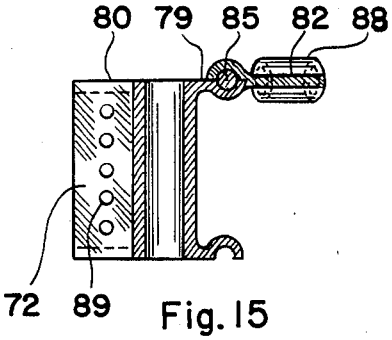
FIG. 15 illustrates a cross section of the connector assembly shown in FIG. 14.

In FIG. 15 there is illustrates a cross section of the connector assembly 71 shown in FIG. 14, which cross seciton is taken along a plane 15—15 as shown in FIG. 14. Each web includes a plurality of bolt holes or rivet holes 89 disposed therethrough. It should be noticed that three connecting brackets 81, 82 and 83 are pivotably connected to any one set of gussets disposed at one extremity of the connector assembly 71. The welding may be employed to substitute the bolt or rivet fastening or to supplement the bolt or rivet fastening.

Figure 16:
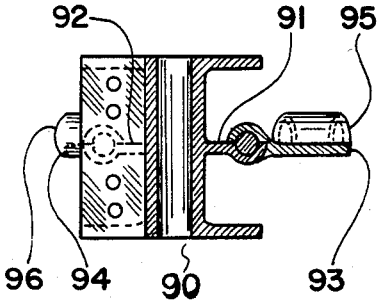
FIG. 16 illustrates a cross section of a further connector assembly employed in constructing a geodesically reinforced honeycomb shell.

In FIG. 16 there is illustrated a cross section of another connector assembly 90 taken along a plane including the central sxis of the connector assembly. The connector assembly 90 is constructed essentially in the same way as the element 71 shown in FIGS. 14 and 15 with one exception being that the connector assembly 90 includes a third set of three gussets 91, 92, etc. disposed on a plane perpendicular to the central axis of the connector assembly 90 that passes substantially through the midsection of the connector assembly 90, which pivotably supports three connecting brackets 93, 94, etc. respectively. It should be noticed that, in the particular embodiment shown in FIG. 16, the center lines of the circular sockets 95, 96, etc. are offset from the middle plane of the connecting bracket.

It is readily realized that, in the construction of the geodesically reinforced honeycomb shell structure 1 shown in FIG. 1, the connector assemblies such as that shown in FIGS. 13 or 14 must be employed at every junction in the hexagonal network wherein the connector assembly employed at one junction must be installed in the inverted position compared with the connector assembly installed in an adjacent junction. The connector assembly shown in FIG. 16 should be employed in constructing a geodesically reinforced honeycomb structure including subassemblies same as that shown in FIG. 4, wherein the connector assembly employed at one junction in the hexagonal network must be installed in the inverted position compared with the connector assembly installed in an adjacent junction. In constructing a geodesically reinforced honeycomb structure such as that shown in FIG. 2, two sets of connector assemblies; one with connecting brackets such as that shown in FIGS. 13 or 16 and one without connecting bracket such as that shown in FIG. 7, should be alternatively installed at alternate junctions in the hexagonal network. In constructing a geodesically reinforced honeycomb structure having the subassemblies such as that shown in FIG. 6, two sets of connector assembly; one with connecting brackets such as that shown in FIGS. 13 or 15 and one without connecting bracket such as that shown in FIG. 7, should be alternatively installed at alternate junctions in the hexagonal networks. It should be understood that one of two sets of gussets included in the connector assembly shown in FIGS. 14 and 15 which does not pivotably support the connecting brackets may be omitted when the requirement of the structural strength permits to do so. One or both sets of the gussets included in the connector assembly shown in FIG. 16 which does not pivotably support the connecting brackets may be eliminated if the condition of the structural strength permits such an elimination. Instead of one set of gussets disposed at the midsection, the connector shown in FIG. 7 may be provided with two sets of gussets respectively disposed at two extremities of the connector, if a further structural strength of the connector is reguired. The principles of the present invention set forth that the universal connector assembly must include connection means for connecting the reinforcing elongated structural members wherein said connection means are pivotable over a small angle with respect to the connector, which requirement may be satisfied by means as illustrated in the illustrative embodiments or by other means.

Figure 17:
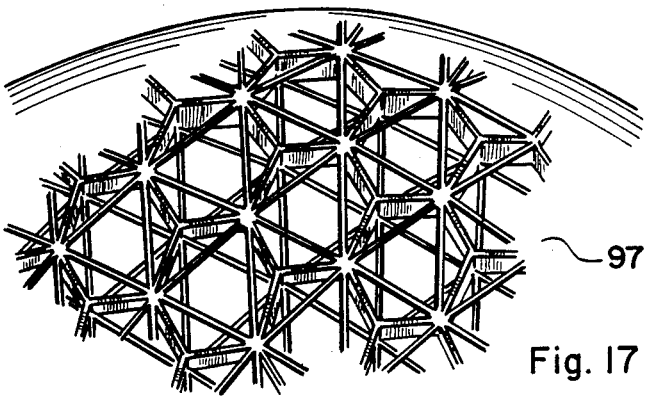
FIG. 17 illustrates a perspective view of an embodiment of the geodesically reinforced honeycomb dome having a curvature.

In FIG. 17 there is illustrated a perspective view of a geodesically reinforced honeycomb dome 97 having a finite curvature constructed in accordance with the principles of the present invention, which is constructed in the same way as that of the geodesically reinforced honeycomb structure shown in FIGS. 1 and 2.

Figure 18:
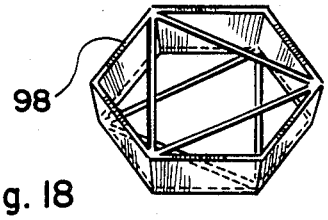
FIG. 18 illustrates subassembly of the geodesically reinforced honeycomb dome, which includes a hexagonal subassembly sandwiched between a pair of reinforcing triangular subassemblies.

In FIG. 18 there is illustrated a hexagonal subassembly 98 usable for the construction of the geodesically reinforced honeycomb dome shown in FIG. 17. The hexagonal subassembly 98 is constructed in essentially the same way as that of FIG. 3 with one exception being that the hexagonal subassembly is tapered as it is a frustum section of a hexagonal conical shell.

Figure 19:
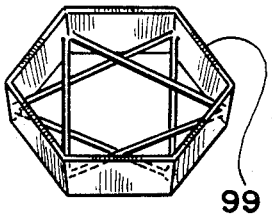
FIG. 19 illustrates another subassembly of the geodesically reinforced honeycomb dome including a hexagonal subassembly reinforced with a pair of reinforcing triangular subassemblies disposed substantially on the middle plane thereof.

In FIG. 19 there is illustrated another hexagonal subassembly 99 usable for the construction of the geodesically reinforced honeycomb dome of a finite curvature, which subassembly 99 is a tapered version of that shown in FIG. 4.

Figure 20:
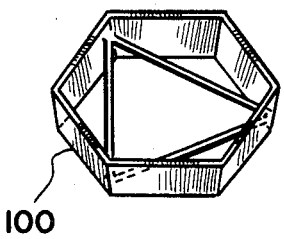
FIG. 20 illustrates a further subassembly of the geodesically reinforced honeycomb dome inlcuding a hexagonal subassembly reinforced with a triangular subassembly disposed substantially on the middle plane thereof.

In FIG. 20 there is illustrated a further hexagonal subassembly of a curved geodesically reinforced honeycomb dome, which is a tapered version of the subassembly shown in FIG. 5.

Figure 21:
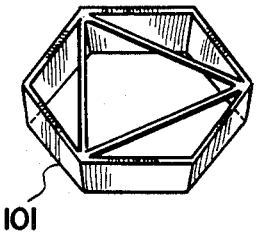
FIG. 21 illustrates still another subassembly of the geodesically reinforced honeycomb dome including a hexagonal subassembly reinforced with a triangular subassembly disposed substantially flush to one surface of the honeycomb dome.

In FIG. 21 there is illustrated still another hexagonal subassembly of a curved geodesically reinforced honeycomb dome, that is the tapered version of the subassembly illustrated in FIG. 6. It is readily recognized that, by providing appropriate tapers to the hexagonal subassemblies shown in FIGS. 3, 4, 5, and 6 as exemplified by the subassemblies shown in FIGS. 18, 19, 20 and 21, a spherically or elliptically or cylindrically curved geodesically reinforced honeycomb dome or shell structure can be constructed.

While the principles of the present invention have now been made clear by the illustrative embodiments, it will be immediately obvious to those skilled in the art many modifications in the arrangements, elements, proportion, structures and materials which are particularly adapted to the specific working environment and operating conditions in the practice of the invention without departing from those principles.

We claim:

1. A geodesically reinforced hexagonal honeycomb structure comprising in combination:

(a) a plurality of elongated structural members having a substantially slender cross section connected together to form a hexagonal network of said hexagonal honeycomb structure; and (b) a plurality of reinforcing elongated structural members arranged into a triangular network superimposed to said hexagonal network wherein each triangle of said triangular network includes three reinforcing elongated structural members disposed within each hexagonal cell of said hexagonal network, and each corner of each triangular cell is connected to alternate corners of said each hexagonal cell;

wherein adjacent triangular cells included in said triangular network are connected to each other in a corner-to-corner pattern.

2. The combination as set forth in claim 1 wherein said geodesically reinforced honeycomb structure is a curved shell.

3. The combination as set forth in claim 2 wherein said triangular network is disposed intermediate two surfaces including said hexagonal network therebetween.

4. The combination as set forth in claim 2 wherein said triangular network is disposed substantially flush to one of two surfaces including said hexagonal network therebetween.

5. A geodesically reinforced hexagonal honeycomb structure comprising in combination:

(a) a plurality of elongated structural members having a substantially slender cross section connected together to form cells of a hexagonal network of said hexagonal honeycomb structure;

(b) a first plurality of reinforcing elongated structural members arranged into a first triangular network superimposed to said hexagonal network wherein each triangle of said first triangular network includes three reinforcing elongated structural members disposed within each hexagonal cell of said hexagonal network, and each corner of each triangular cell is connected to a first set of alternate corners of said each hexagonal cell; and (c) a second plurality of reinforcing elongated structural members arranged into a second triangular network superimposed to said hexagonal network wherein each triangle of said second triangular network includes three reinforcing elongated structural members disposed within each hexagonal cell of said hexagonal network, and each corner of each triangular cell is connected to a second set of alternate corners of each hexagonal cell;

wherein adjacent triangular cells included in said first triangular network are connected to each other in a corner-to-corner pattern and adjacent triangular cells included in said second triangular network are connected to each other in a corner-to-corner pattern.

6. The combination as set forth in claim 5 wherein said geodesically reinforced honeycomb structure is a curved shell.

7. The combination as set forth in claim 6 wherein said first and second triangular networks are disposed intermediate two surfaces including said hexagonal network therebetween.

8. The combination as set forth in claim 6 wherein said first triangular network is disposed substantially flush to one of two surfaces including said hexagonal network therebetween and said second triangular network is disposed substantially flush to the other of said two surfaces including said hexagonal network therebetween.

9. A connector for interconnecting three elongated structural members of substantially slender cross section included in a hexagonal network, said connector comprising in combination:

(a) central axis portion and six webs disposed parallel to and extending from the central axis portion of said connector in an axisymmetric pattern and respectively forming three slots for receiving said substantially slender sections of said elongated structural members included in said hexagonal network, each of said slots including fastening means for securing said elongated structural member to said connector; and (b) three connecting brackets, each of said connecting brackets including means for receiving and securing two reinforcing elongated structural members, said three connecting brackets respectively disposed intermediate said three slots and connected to said connector in a pivotal relationship wherein ech of said connecting bracket is pivotble about an axis substantially perpendicular to said central axis portion of said connector.

10. The combination as set forth in claim 9 wherein said three connecting brackets are disposed intermediate two extremities of said connector.

11. The combination as set forth in claim 9 wherein said three connecting brackets are disposed adjacent to one extremity of said connector.

* * * * *